United States Patent [19]

Staggs

[11] Patent Number: 4,775,857

[45] Date of Patent: Oct. 4, 1988

[54] ON-LINE VERIFICATION OF VIDEO DISPLAY GENERATOR

[75] Inventor: Kevin P. Staggs, Glendale, Ariz.

[73] Assignee: Honeywell Inc., Minneapolis, Minn.

[21] Appl. No.: 65,117

[22] Filed: Jun. 19, 1987

Related U.S. Application Data

[63] Continuation of Ser. No. 735,241, May 17, 1985, abandoned.

[51] Int. Cl.[4] ..... G09G 1/16

[52] U.S. Cl. ..... 340/715; 340/703; 340/747; 371/25

[58] Field of Search ..... 340/715, 747, 703; 371/25

[56] References Cited

U.S. PATENT DOCUMENTS

| | | | |
|---|---|---|---|
| 3,524,022 | 8/1970 | Schoenthal | 178/15 |
| 3,753,032 | 8/1973 | Naidich et al. | 340/715 |
| 3,866,171 | 2/1975 | Loshbough | 340/715 |
| 4,464,655 | 8/1984 | Bird | 340/715 |
| 4,483,002 | 11/1984 | Groom, Jr. et al. | 340/747 |

*Primary Examiner*—Marshall M. Curtis
*Attorney, Agent, or Firm*—A. A. Sapelli; D. J. Lenkszus; A. Medved

[57] ABSTRACT

On-line verification apparatus of a display generation system comprises a memory which has a display portion and an inactive display portion, the display portion storing display information, and the inactive display portion storing test data. Scan logic controls a monitor, the scan logic accessing the memory at a predetermined location corresponding to the position control signals. A generator generates display control information to provide information control signals to the scan beam thereby providing the visual display corresponding to the display information stored in the display portion of the memory. A register stores display control information generated from the test data stored in the inactive display portion of the memory during a retrace period. The display control information stored in the register corresponding to the test data is compared to an expected result, during the retrace period, thereby verifying on-line that the display generation system is functioning correctly.

10 Claims, 6 Drawing Sheets

ON-LINE VERIFICATION OF VIDEO DISPLAY GENERATOR

This is a continuation of co-pending application Ser. No. 06/735,241 filed on May 17, 1985 now abandoned.

RELATED PATENT APPLICATIONS

This invention may be employed in a Video Display Generator such as that disclosed in U.S. patent application Ser. No. 721,021, filed 04/08/85, entitled "Memory Access Modes for a Video Display Generator", by K. Staggs and C. Clarke, now U.S. Pat. No. 4,663,619 and U.S. patent application Ser. No. 340,141 filed 01/18/82, U.S. Pat. No. 4,490,797, entitled, "Method and Apparatus for Controlling the Display of a Computer Generated Raster Graphic System", both applications ed to the same assignee as the present application.

BACKGROUND OF THE INVENTION

This invention relates to video display systems, and more particularly to an apparatus for the on-line verification of the functionality of the various subsystems within the video display system.

In existing video display systems which include logic such as raster scan logic, counters, video memories, and shift registers, verification of the system while still on-line is accomplished by displaying a test pattern for the user to examine and left for the user to observe the test pattern and conclude that everything is functioning properly if the test pattern conforms to the expected display. This technique has worked whenever the user is looking for something wrong, but the first drawback is that the user has to think something is wrong. The present invention takes the user out of the loop for determining if something is wrong and verifies that the system is functioning properly on-line without interfering with the information being displayed, and without intervention by the user.

SUMMARY OF THE INVENTION

Therefore, there is supplied by the present invention an apparatus for the on-line verification of the functionality of a video display system. In a display generation system, having a monitor for providing a visual display, the visual display being projected on a display surface by a scan beam associated with the monitor in response to position control signals and information control signals, an apparatus for on-line verification of the display generation system, comprising a memory. The memory has a display portion and an inactive display portion, the display portion of the memory being utilized for storing display information to be displayed on the monitor, and the inactive display portion being utilized for storing test data. Scan logic, operatively connected to the memory, controls the monitor, including providing the position control signals to the monitor. The scan logic accesses the memory at a predetermined location corresponding to a predetermined position of the scan beam of the monitor. A generator, operatively connected to the memory, generates display control information from the display information, the display control information being operatively coupled to the monitor to provide the information control signals to the scan beam thereby providing the visual display corresponding to the display information stored in the display portion of the memory. A register, operatively connected to generator, stores display control information generated from the test data stored in the inactive display portion of the memory, the register being enabled by a control signal generated from the scan logic indicating the end of a display frame. The control signal corresponds in time to when the test data is being accessed by the scan logic. The scan logic is operative during a period of time that the monitor is blanked, the monitor being blanked thereby allowing the scan beam of the monitor to be positioned to a beginning point of the visual display. An element, operatively connected to the register, compares the display control information stored in the register corresponding to test data, to an expected result, the comparison being performed during the period of time the monitor is blanked, thereby verifying on-line that the display generation system is functioning correctly and to indicate an error when no comparison exists.

Accordingly, it is an object of the present invention to provide an apparatus for on-line verification of a display system.

It is another object of the present invention to provide an apparatus for on-line verification of a display system without involving a human operator.

It is still another object of the present invention to provide an apparatus for on-line verification of a display system without interfering with the normal display operation of the display system.

These and other objects of the present invention will become more apparent when taken in conjunction with the following description and attached drawings, wherein like characters indicate like parts, and which drawings form a part of the present application.

DETAILED DESCRIPTION

Figure 1:
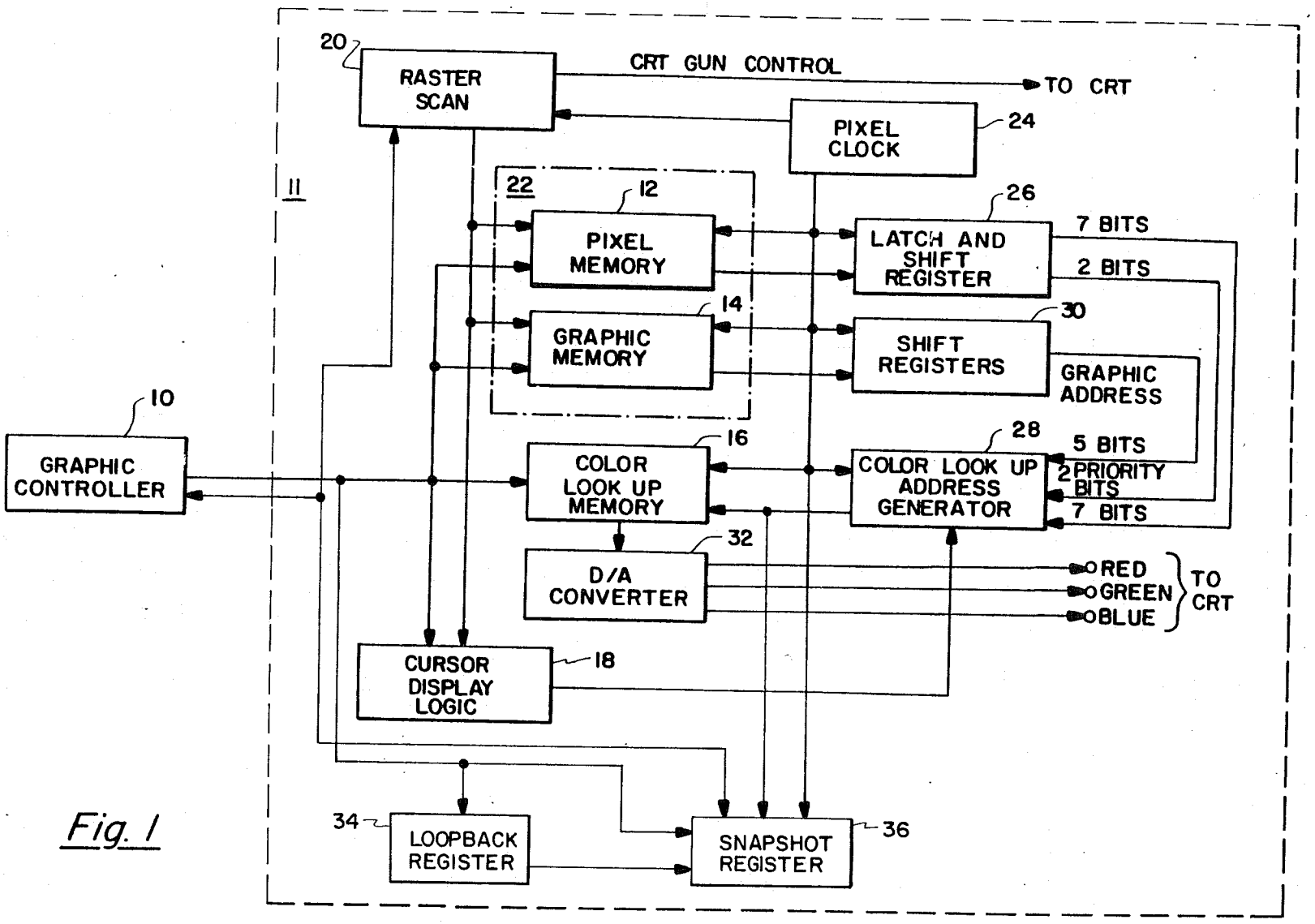
FIG. 1 shows an apparatus for a display generation system.

Referring to FIG. 1, there is shown an apparatus for a display generation system. A graphics processor 10 of the preferred embodiment includes a Motorola 68000 microprocessor (not shown) and an associated RAM (not shown). The graphics processor 10 interfaces with a video display generator 11. The video display generator 11 provides the necessary signals to generate displays on and control of a raster scan CRT monitor (not shown). The video display generator 11 includes various display and control memories 22, 16, a cursor display logic 18, raster scan logic 20, color look-up address generation logic 28, and a D/A converter 32. A pixel clock 24 is included to produce the required clocking signals for the video display generator. Latches and shift registers 26, 30 are operatively coupled to the display memory 22, and along with the clocking signals from the pixel clock 24, are shifted in a synchronous fashion to correspond to the scanning of the beam of the CRT monitor in order to produce the desired display.

In the preferred embodiment of the present invention, a loopback register 34 and a snapshot register 36 are added. The loopback register 34 provides the capability for the graphics processor 10 to write various data patterns into the loopback register 34 and read the data back which accomplishes the verification of the data paths to and from the graphics processor 10. The snapshot register 36 stores an 8-bit output generated by the color lookup address generator 28 based on a predetermined input, the predetermined input being known information stored in display memories 22 by the graphics processor 10. The 8-bit output stored in snapshot register 36 is checked by the graphics processor 10 to determine if the correct output has been generated, thereby verifying several of the logic blocks within the video display generator 11. These added registers permit the video display generator 11 to be tested while continuing to provide operational displays on the CRT monitor, i.e., the testing is being performed in an on-line mode.

The raster scan logic 20 generates all of the timing and sync signals for the raster scan CRT monitor (not shown) and the necessary timing and control signals for all accesses of the display memories 22. Counters (not shown) in the raster scan logic 20 determine which displayable element on the raster scan CRT monitor is currently being displayed and which address to access in the display memories 22.

The display memories 22 are organized in two different forms referred to as the picture element (pixel) memory 12 and the alphagraphic memory (also referred to as the graphic memory) 14. A more detailed description of the format of the pixel memory 12 and the graphic memory 14 will be described in detail hereinunder.

The cursor display logic 18 generates a visible cursor which can be positioned anywhere on the display under control of the graphic controller 10. A more detailed description of the generation of cursors for a raster graphic display can be had by referring to application, Ser. No. 522,140 filed 08/11/83, entitled "Method and Apparatus for Generating Cursors for a Raster Graphic Display", assigned to the same assignee as the present application.

The color lookup address generation logic 28 determines if the current displayable element is a pixel, alphagraphic, or cursor element (based on the display priority) and uses this determination along with the proper index bits (pixel or alphagraphic) to access a location in the color lookup memory 16. The color lookup memory 16, at locations having addresses corresponding to the color addresses applied by the color lookup address generator logic 28, has stored color control signals which are used to control the intensity of the electron beams of the color guns of a conventional color CRT monitor (not shown) and which determine the color and intensity of each picture element of the display array as it is scanned. eight-bit byte is stored in the color lookup memory 16 at locations corresponding to the color addresses applied. In synchronism with the scanning of each pixel of the display, the color control signal is read out of color lookup memory 16 and applied to D to A converters 32. D to A converters 32 convert 6 of the 8 binary signals into analog signals for controlling intensity of the red, green, and blue electron beam guns of the conventional CRT monitor. In addition, in the preferred embodiment, two bits of the color control signal are applied to a fourth D to A converter which converts these two bits into a monochrome analog signal which can be used to produce a permanent record of the raster display using conventional equipment, as is well known in the art. A more complete description of the color lookup address generation logic 28 and the associated color lookup memory 16 can be had by referring to U.S. Pat. No. 4,490,797 entitled "Method and Apparatus for Controlling the Display of a Computer Generated Raster Graphic System," assigned to the same assignee as the present application.

Before proceeding with describing the on-line verification of the present invention, an understanding of the operation of some of the components of the video display generator 11 is in order.

Figure 2:
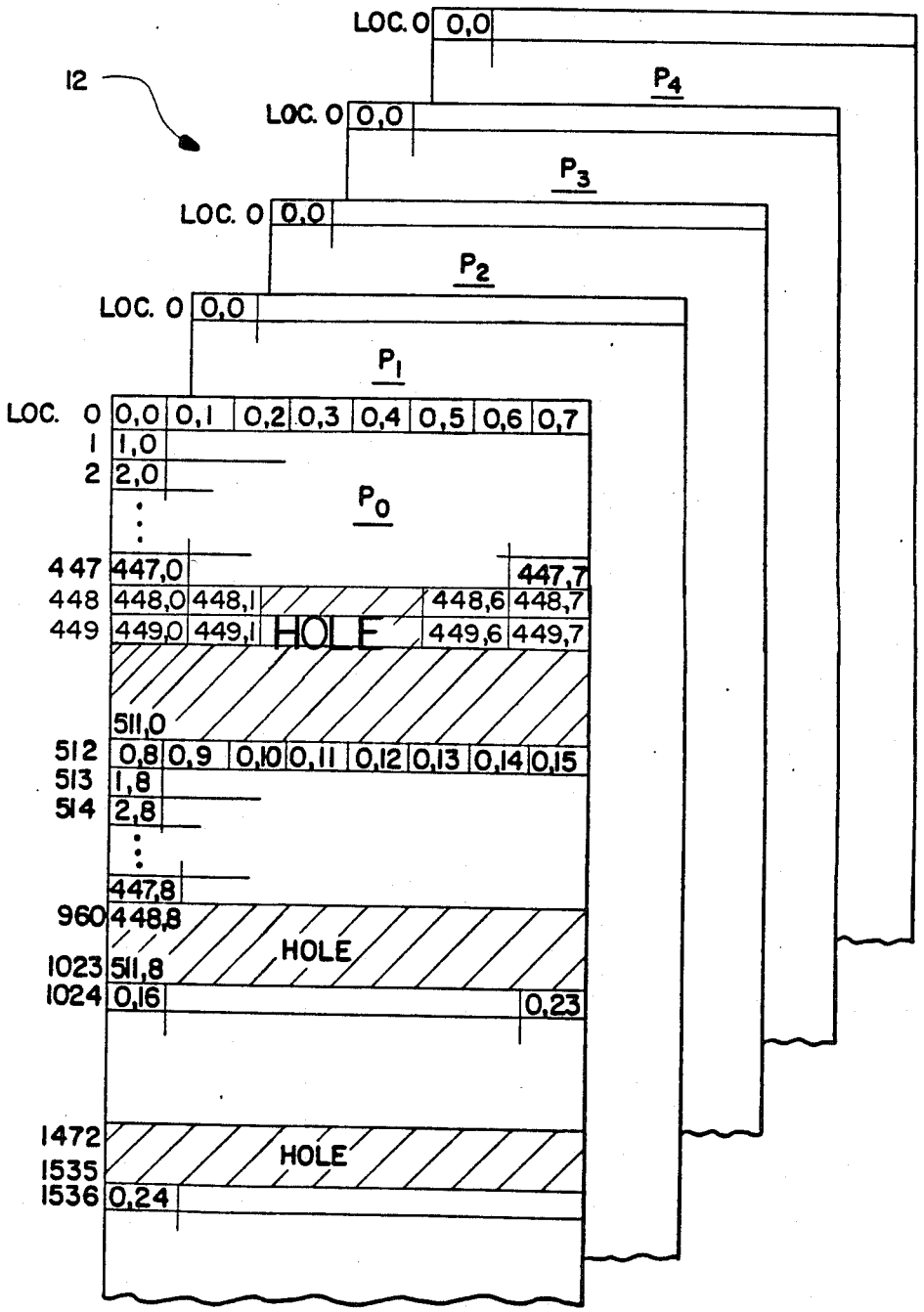
FIG. 2 shows an organization of a pixel memory of the display generation system.
Figure 3:
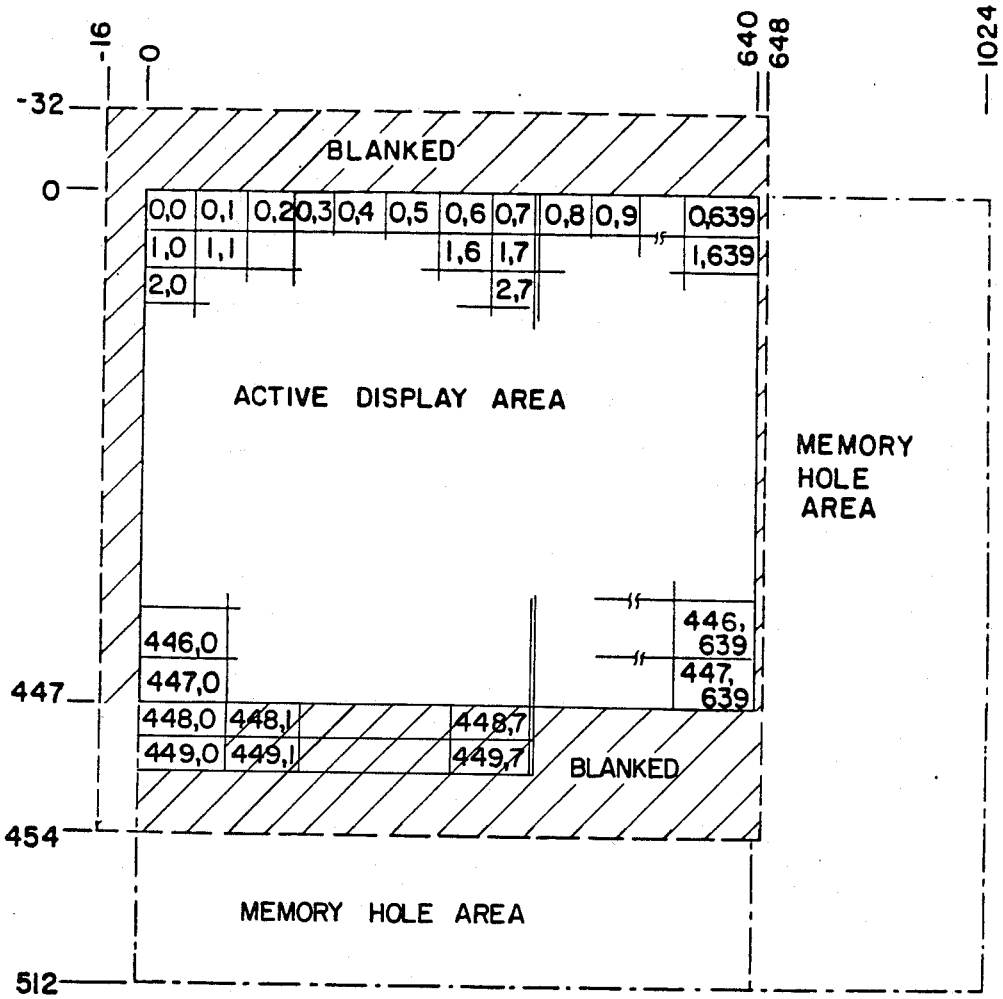
FIG. 3 shows a layout of a CRT display for the display generation system as it corresponds to the pixel memory organization.

FIG. 2 shown an organization of the pixel memory 12 and FIG. 3 shows a layout of the CRT monitor display. Referring to FIGS. 2 and 3, the relationship of the organization of the display memory 22 (although the discussion with respect to FIG. 2 will be specifically directed to the pixel memory 12, there is a similar organization for graphic memory 14) will now be described. The active display area of the CRT monitor of the preferred embodiment of the present invention is divided into 640 horizontal elements and 448 vertical elements. A character size chosen for the display of the preferred embodiment is a $5\times9$ character in an $8\times16$ character cell (i.e., 8 horizontal pixels by 16 vertical pixels). The pixel memory 12 contains five planes, p0, p1, p2, p3, and p4. Each plane is an 8-bit wide by 64K memory. Each location of each plane contains 8 bits of information relating to 8 corresponding picture elements. Hence, location 0 of the pixel memory 12 contains information relating to picture elements 0,0 through 0,7 of the display. The first bit of location 0 of pixel memory 12 contains information relating to picture element 0,0 of the display, the second bit of location 0 of pixel memory 12 contains information relating to picture element 0,1 of the display, . . . In order to display the information of the display memory 22, it is necessary that the information in display memory 22 correspond to the position of the sweep of the CRT monitor (not shown). In raster scan CRT monitors, generally the sweep is a horizontal sweep from left to right, top to bottom, in which the sweep starts at location 0,0 and moves horizontally across the display to location 0,639. Thus, the information fetched from display memory 22 for display must correspond to the positioning of the sweep of the CRT monitor. Namely, location 0 of display memory 22 is fetched which corresponds to picture elements 0,0 through 0,7, then location 512 of display memory 22 is fetched which corresponds to the picture elements 0,8 through 0,15, then location 1024 is fetched . . . up to location 40448 which corresponds to picture element 0,632 through 0,639. The next line of the display (picture element 1, 0 through 1, 639 is scanned and the corresponding information is fetched from the display memory 22 at location 1, 513, 1025. . . . When line 447 is completed, the display has been completed and the scanning is restarted at line 0. The hole area in memory corresponds to the display area 448 511. Hence, locations 448 through 511, 960 through 1023, 1472 through 1535, . . . of display memory 22 have no corresponding active display area. The fetch of the information from display memory 22 is performed by logic in the raster scan logic 20. By adding 1 to bit 9 (i.e., to the 512 bit position) of an address counter, the correct addressing scheme is generated corresponding to the CRT beam as it is swept across a horizontal line. By allowing the hole area in memory, the implementation of incrementing the counter of the raster scan logic is simplified. The area of the display from 640 to 1023 also corresponds to a memory hole area from locations 40960 to 64K (i.e., 65535). The apparent inefficient use of memory is more than negated by the ease of implementing an addressing scheme corresponding to the display layout.

Although a line by line scanning of the display area has been described, alternative vertical scanning techniques are well known. In the preferred embodiment of the present invention interlace scanning is implemented with the organization of the display memory 22 just described. The raster scan logic is implemented such that the low order bit position of the counter for accessing the display memory 22 is alternately set between a 1 and a 0 on alternate vertical scans as will be described hereinunder.

The alphagraphic memory 14 also corresponds to a display which is 640 horizontal elements and 448 vertical elements. The graphic memory 14 consists of 2 memory planes with each plane organized such that each 8-bit byte corresponds to 8 horizontal elements by 1 vertical element. In a first plane, denoted a dot memory, each bit determines if the picture element is a foreground or background color. In a second plane, denoted the behavior memory, each 8 bit location determines the behavior index of an entire associated location in the dot memory, and the display priority between the pixel memory 12 and the alphagraphic memory 14. Of the 8 bits, a behavior index is 6 bits and a display priority is 2 bits. The 6 bits representing the behavior index and the 1 bit identification of each foreground or background color results in a 7 bit value used as an index into the color lookup memory 16. The 2 priority bits determine the priority of the pixel display with respect to the alphagraphic display. The priority is one of three levels which are more fully described in the aforementioned references. The pixel memory 12 stores characteristic information for each pixel element; namely, planes 0–2 contains color information, plane 3 contains intensity information, and plane 4 contains blink information.

Figure 4:
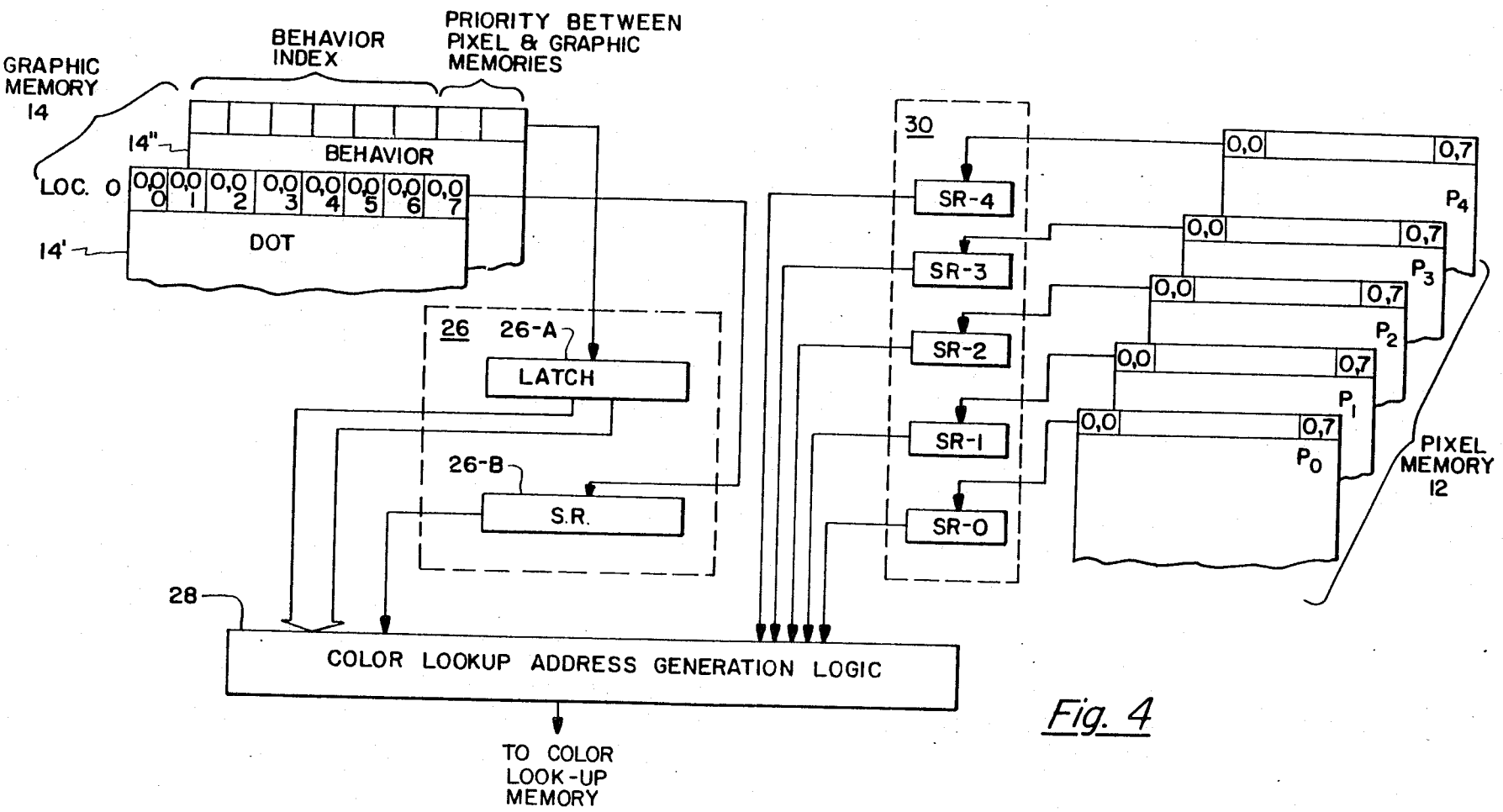
FIG. 4 shows some of the logic of the display generation system utilized for displaying the information stored in the display memories.

Referring to FIG. 4, there is shown some of the logic of the video display generator 11 utilized for displaying the information stored in the display memories 22. The raster scan logic 20 reads the alphagraphic memory 14 and the pixel memory 12 at the same location, in the example shown in FIG. 5 location 0 is being read. The 8 bits from the dot memory 14′ are loaded into a shift register 26B and the 8 bits from location 0 of the behavior memory 14″ are being loaded into a latch 26A. Likewise, the contents of location 0 of each plane of the pixel memory 12 is loaded into a corresponding shift register. Thus, the 8 bits of location 0 from plane 0 is loaded into shift register SR-0, the 8 bits from location 0 of plane 1 is loaded into SR-1, . . . , and the 8 bits from location 0 of plane 4 is loaded into SR-4. All of the shift registers are shifted such that the color lookup address generation logic 28 processes the information related to picture element 0,0 from both the pixel memory 12 and the dot memory 14′. Processing is performed to correspond to the information contained in latch 26A. At this point in time the sweep of the CRT monitor is at location 0,0 of the display. Synchronized by the clocking signal, the display moves to the next position, i.e., picture element 0,1 of the display and likewise the information corresponding to location 0,1 is shifted into the color lookup address generation logic 28 from the shift registers 30 and the shift register 26B. Again, this information is processed by the color lookup address generation logic 28 as defined by the information latched in latch 26A, which is valid for the 8 bits of location 0. The process continues until the sweep of the CRT monitor has displayed the 8 picture elements of a horizontal line. The next element to be displayed is location 0,8 which corresponds to address 512. The raster scan logic 20 causes a read of location 512 from the graphic memory 14 and the pixel memory 12 into the shift registers and latch and the above process continues until the entire line is displayed, and then continues as described above until the entire display area has been processed for display.

Figure 5:
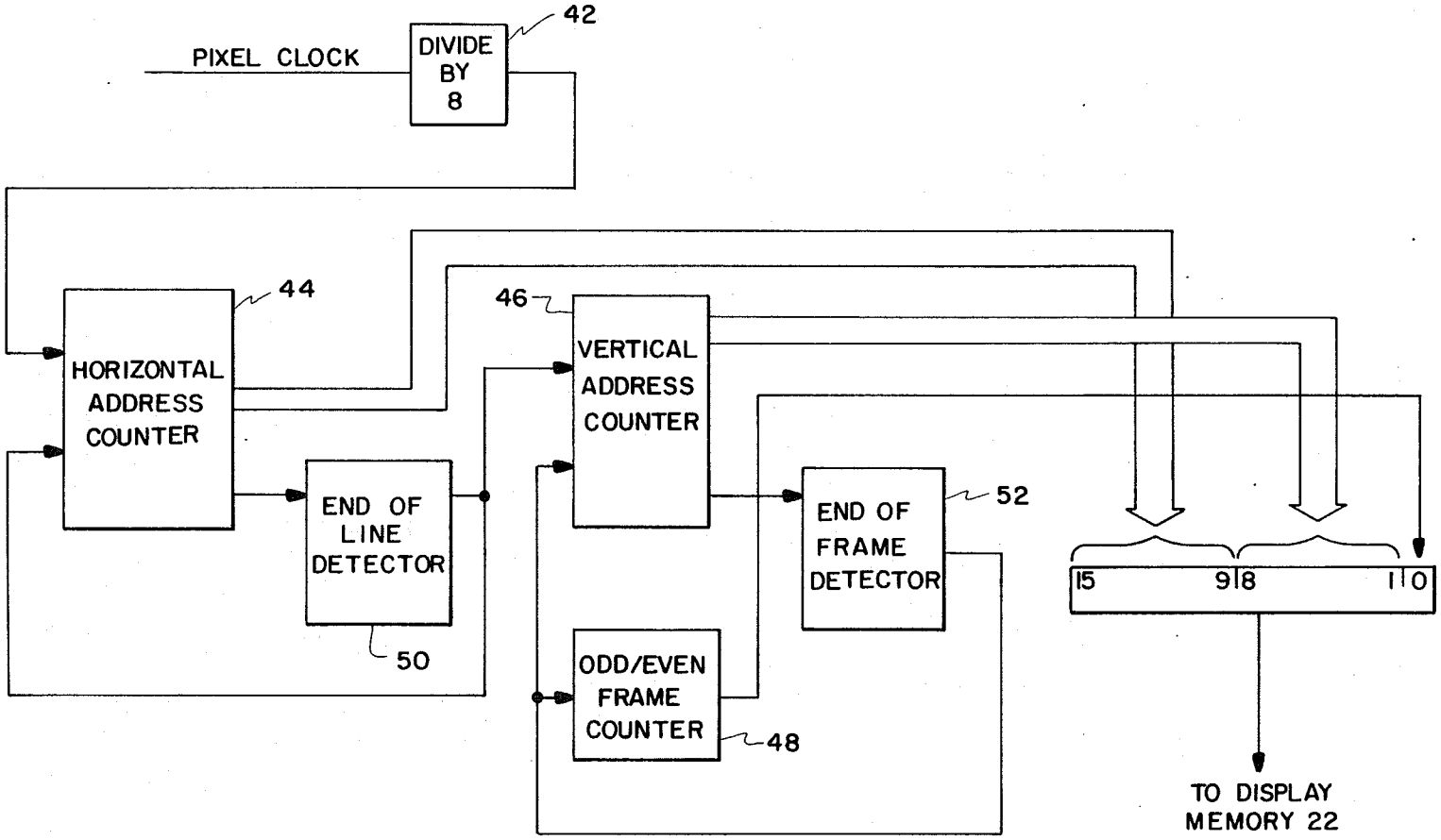
FIG. 5 shows a partial functional logic block diagram of the raster scan logic of the display generation system.

Referring to FIG. 5, there is shown a partial functional logic block diagram of the raster scan logic 20. The counters shown in FIG. 5 are part of the raster scan logic 20 which are verified by the verification apparatus of the present invention and include a divide-by-eight circuit 42 of the pixel clock signal, horizontal address counter 44, vertical address counter 46, an odd/even frame counter 48, an end-of-line detector 50, and an end-of-frame detector 52. The outputs of the horizontal address counter 44, vertical address counter 46, and odd/even frame counter 48 are coupled to the display memory 22 for addressing the display memory. The outputs of the horizontal address counter 44, the vertical address counter 46, and the odd/even frame counter 48, make up the display memory address. The output of the odd/even frame counter 48 makes up the least significant bit portion, the 8-bits outputted from the vertical address counter 46 make up the next least significant bits of the memory address, and the 7-bits outputted from the horizontal address counter make up the most significant bit portion of the display memory address. The pixels are read from the display memory 22 in groups of eight pixels at a time and loaded into shift registers and latches 26, 30 as described above therefore requiring the pixel clock signal to be divided by eight when clocking the horizontal address counter 44. The horizontal address counter 44 is allowed to continue to count during horizontal retrace, the count being used for generating synchronizing signals. The retrace count for the horizontal address counter 44 of the preferred embodiment of the present invention is 16 cells which result in a total count of 768 for each horizontal line. When the end-of-line detector 50 determines that the horizontal address counter 44 is at the end of a current scan line, the end-of-line detector 50 asserts an end-of-line signal back to the horizontal address counter 44 which resets the counters to a value of −14. While the counters are incrementing from −14 to 0 the display is blanked and the video display generator 11 is generating horizontal synchronization signals to the CRT monitor (not shown). Also, when the end-of-line detector 50 sends the end-of-line signal, the vertical address counter 46 is incremented. In the preferred embodiment of the present invention, the video display generator 11 is an interlace system, two frames of the display comprising a single complete display. One frame is all of the even horizontal lines of the display and the other frame is all of the odd horizontal lines of the display. During each vertical scan of the CRT monitor, the frames are alternated as a result of the odd/even frame counter 48. The vertical address counter 46 is similar in operation to the horizontal address counter 44 except that the vertical address counter 46 is only incremented at the end of each horizontal scan line. When the end-of-frame detector 52 senses that the display is at the end of the frame an end-of-frame signal is generated, the vertical address counter 46 is reset to −16, and the odd/even frame counter 48 is toggled. While the vertical address counter 46 is counting from the count of −16 to 0, the CRT display is blanked and the video display generator 11 is generating the synchronization signals to the CRT monitor.

Figure 6:
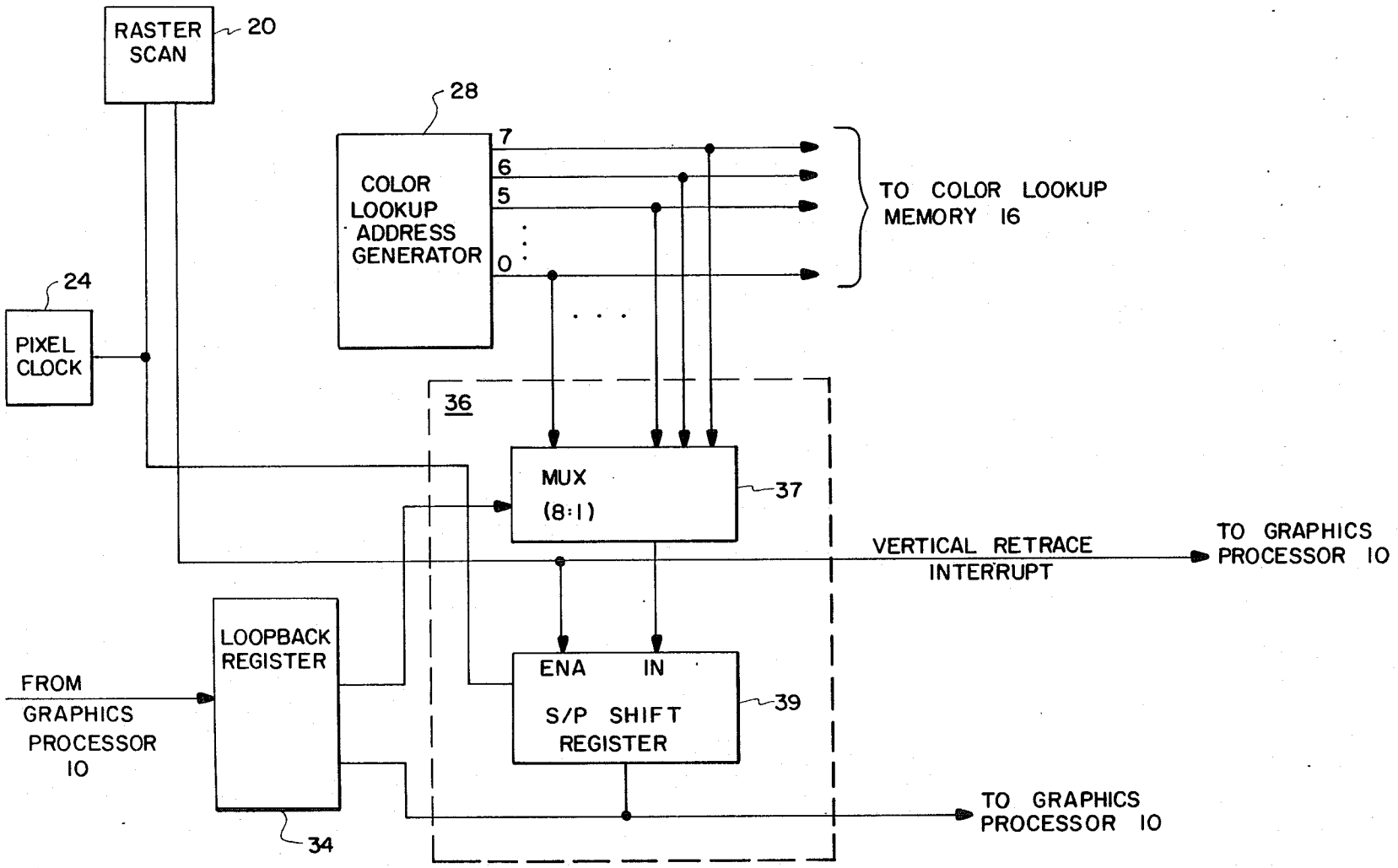
FIG. 6 shows a block diagram of the apparatus added to the display generation system to provide the on-line verification function.

What has been described thus far is the normal operation of the video display generator 11. Referring to FIG. 6, there is shown a block diagram of the apparatus added to the video display generator 11 to provide the on-line verification function. In order to permit the on-line verification of the video display generator 11, the end-of-frame signal is utilized as a vertical retrace interrupt signal back to the microprocessor of the graphics processor 10. Referring back to FIGS. 2 and 3, when the video sweep has reached the point 447, 639, the odd frame is completed and the vertical retrace signal is generated (point 446, 639 is the last point for the even frame). Since the horizontal address counter 44 and the vertical address counter 46 continue to count during retrace, the logic will address location 449 of the display memories 22 which corresponds to the points 449,0 through 449,7 (for the even frame the location to be addressed and accessed is location 448 which corresponds to points 448,0 through 448,7). Although locations 448,0-7 and 449,0-7 are in the "hole" area of display memory 22 (i.e., there is no corresponding active display area for these locations) test data is prestored into locations 448 and 449. Since the logic of the video display generator 11 is active, the counters of raster scan 20 are counting during the retrace period, and the locations in the hole area are being accessed.

Referring back to FIG. 6, the end-of-frame signal (or vertical retrace interrupt which is active for eight pixel times or eight bits) enable a serial-to-parallel shift register 39 during a portion of the retrace period while location 449 is being addressed (location 448 for the even frame). The address information contained on the data lines from color lookup address generator 28 correspond to the eight bits of address information generated by the counters and shift registers of the logic of video display generator 11 based on the test data stored in location 449 (location 448 for the even frame retrace). An interrupt routine in the graphics processor 10 sets up the loopback register 34 such that a MUX 37 sequentially inputs the generated address information from the color lookup address generator 28 into the -serial-to-parallel shift register 39. When the shift register 39 is full the data is read by the graphics processor 10 and compared to an expected result. The test data stored in the display memory 22 is varied by the graphics processor 10 to different patterns to ensure all the logic of the video display generator 11 is adequately tested. Since the color lookup memory is a RAM the color lookup memory 16 can be tested by reading and writing into the RAM. The loopback register 34 is utilized to verify the data paths from the graphics processor 10 to the video display generator 11 and can be done in an off-line as well as an on-line mode. Thus, all the logic of the video display generator 11 can be verified on-line up to the inputs to the D to A converters 32. If the data read from the shift register 39 does not contain the expected result an error signal can be raised, or a number of retries can be executed until a hard failure is signalled, the determination of the hard failure being a design choice.

In the preferred embodiment of the present invention, eight vertical frames are necessary to verify the test word addresses generated by the color lookup address generator 28. The choice to capture the generated addresses in the above described manner results in less hardware and is a matter of design choice. Thus, for example, in the preferred embodiment of the present invention, during the first retrace loopback register 34 is set up to select bit 0 of the output of color lookup address generator 28, and the results stored in the shift register 39 are for the first pixel-bit 0, second pixel-bit 0, . . . eighth pixel-bit 0. For the next vertical retrace, loopback register is set up by graphic controller 10 to read bit 1, . . . until the eighth retrace when bit 7 for all eight pixels of the test word are read.

While there has been shown what is considered the preferred embodiment of the present invention, it will be manifest that many changes and modifications can be made therein without departing from the essential spirit and scope of the invention. It is intended, therefore, in the annexed claims to cover all such changes and modifications which fall within the true scope of the invention.

I claim:

1. In a video display generator having means for producing color address signals for a RAM color look up memory storing color control signals in addressable storage locations, the color control signals stored in an addressable location of the color look up memory determining the color and intensity of each pixel of a raster scan color CRT scanned by electron beams of the CRT, the pixels of the CRT being arranged in horizontal lines and vertical columns, the line and column number of each pixel constituting each pixel constituting each pixels address; a RAM display memory having addressable memory locations for storing binary data; clock means for producing clock signals, the frequency of which substantially equals the frequency at which each pixel in a given horizontal line of pixels of the array of pixels of the CRT is scanned by the scanning electron beams of the CRT; address counter means to which the clock signals are applied for producing address signals of a pixel as that pixel is scanned, the address signals of a pixel also being the address of a memory location in the display memory, said address counter means producing addresses during each horizontal and vertical retrace operation of the electron beams of the CRT, a horizontal line retrace operation beginning when the last pixel of a horizontal line is scanned and a vertical retrace operation beginning when the last line of a set of horizontal lines of the raster is scanned by the electron beams of the CRT; said display memory having an addressable location for each address produced by the address counter means and the addresses of which are the addresses produced by the address counter means, the improvements comprising:

graphic controller means for writing into a first set of addressable memory locations of the display memory binary data signals, the addresses of the first set of addressable memory locations corresponding to the addresses of pixels of the CRT and a second set of addresses for which there is no corresponding pixel, said data signals when read from the display memory in response to address signals being applied thereto by the address counter means being utilized by the video display generator to produce a set of color address signals, said graphics controller means writing test data into the second set of addressable memory locations of the display memory, the addresses of the second set of addressable memory locations of the display memory having addresses produced by the address counter means during a retrace operation; and snapshot register means for storing color address signals produced by the video display generator when test data stored in the second set of addressable memory locations of the display memory is read out of the display memory; said graphics controller means comparing the color address signals stored in the snapshot register means with the color address signals that the test data stored in the display memory means should cause the video display generator to produce to determine the accuracy of operation of the video display generator.

2. In a video display generator as set forth in claim 1 in which the graphic controller means writes test data into addressable locations the addresses of which are produced during a vertical retrace operation.

3. In a video display generator as set forth in claim 2 in which the snapshot register means stores a predetermined number of the set color address signals produced from the test data.

4. In a video display generator as set forth in claim 3 in which the snapshot register means stores one color address signal of each set of color address signals produced during a vertical retrace.

5. In a video display generator as defined in claim 4 in which the graphic controller controls which address signal of each set of color address signals is stored in the snapshot register means during each vertical retrace.

6. In a video display system, a raster scan color CRT; video display generator means including a color lookup RAM, a display RAM for storing data signals at addressable locations of the display RAM, said video display generator means producing a set of color lookup address signals for the color lookup RAM from data signals read from a first set of addressable locations of the display RAM. the addresses of the first set corresponding to the addresses of pixels of the CRT, the data signals being read from the display RAM in synchronism with the scanning of each pixel determining the set of color address signals produced by the video display generator, which set of color address signals are applied to the color lookup RAM, said color lookup RAM in response to a set of color address signals being applied to the color lookup RAM producing color control signals which determine the color and intensity of the pixel being scanned; address counter means for producing the address of each pixel of the CRT substantially as it is scanned; circuit means for applying addresses produced by the address counter means to the display RAM; and a graphic controller for writing data into the addressable locations of the display RAM; and for controlling the operation of the visual display generator;

the improvements comprising;

an additional set of addressable storage locations in the display RAM for storing test data signals written into the display RAM by the graphic controller, the address counter means producing addresses of addressable storage locations of the second set of addresses located in the display RAM during each retrace operation of the CRT; said video display generator producing a set of color lookup address signals for the color lookup RAM from the test data signals read out of each of the second set of storage locations of the display RAM; and a snapshot register for storing color lookup address signals produced from test data stored in the second set of addressable storage locations of the display RAM during a retrace operation by the CRT, said graphics controller comparing the color lookup address signals stored in the snapshot register during a retrace operation with correct values of the color lookup addresses the video display generator should produce from the test data stored in the second set of addressable storage locations of the display RAM.

7. In a video diplay system as defined in claim 6 in which the snapshot register stores a predetermined number of a set color address signals.

8. In a video display system as defined in claim 7 in which the snapshot register stores one color address signal of each set of color address signals produced from the test data.

9. In a video display system as defined in claim 8 in which the graphic controller determines which color address signal of each set of color address signals is stored in the snapshot register.

10. The method of verifying the operation of a video display generator for a raster scan color CRT of a video display system comprising the steps of:

(1) writing test data into a display memory at locations having addresses produced by an address generator during each retrace operation of the CRT;

(2) reading the test data from the display memory during selected retrace operations;

(3) converting the test data read from the display memory in step 2 into a set of address signals of a color look up memory;

(4) storing the address signals produced in step 3;

(5) comparing the signals stored in step 4 with a color address the test data should produce; and (6) producing an error signal if in step 5 a difference is detected.

* * * * *